United States Patent [19]

Kato et al.

[11] 4,239,815

[45] Dec. 16, 1980

[54] METHOD OF PRODUCING RECORDING SHEETS

[75] Inventors: Hajime Kato; Yasuhiro Ogata, both of Fujinomiya, Japan

[73] Assignee: Fuji Photo Film Co., Ltd., Ashigara, Japan

[21] Appl. No.: 967,460

[22] Filed: Dec. 7, 1978

[30] Foreign Application Priority Data

Dec. 7, 1977 [JP] Japan ..... 52-146877

[51] Int. Cl.[3] ..... B41M 3/12

[52] U.S. Cl. ..... 427/150; 282/27.5; 427/157; 427/152; 427/419.1; 427/419.5; 427/419.8; 428/488; 428/537; 428/539; 428/914

[58] Field of Search ..... 427/150–152, 427/419 R, 419 D, 419 G; 282/27.5; 428/539, 537, 488, 914

[56] References Cited

U.S. PATENT DOCUMENTS

| | | | |
|---|---|---|---|
| 3,772,052 | 11/1973 | Kimura et al. | 428/341 |
| 3,871,900 | 3/1975 | Hayashi et al. | 282/27.5 |
| 3,900,215 | 8/1975 | Kato et al. | 282/27.5 |
| 4,022,936 | 5/1977 | Miller et al. | 427/151 |
| 4,046,941 | 9/1977 | Saito et al. | 427/150 |
| 4,051,303 | 9/1977 | Hayashi et al. | 427/150 |
| 4,087,284 | 5/1978 | Golden | 427/157 |
| 4,159,208 | 6/1979 | Hayashi et al. | 427/150 |

*Primary Examiner*—Ronald H. Smith
*Assistant Examiner*—Janyce A. Bell
*Attorney, Agent, or Firm*—Sughrue, Rothwell, Mion, Zinn and Macpeak

[57] ABSTRACT

A recording sheet for pressure-sensitive copying paper is produced by coating on a support a coating composition containing a water-soluble polyvalent metal salt and then a coating composition containing an alkali metal salt or an ammonium salt of an aromatic carboxylic acid.

The recording sheet has excellent flatness and surface strength.

12 Claims, No Drawings

METHOD OF PRODUCING RECORDING SHEETS

BACKGROUND OF THE INVENTION

1. Field of the Invention

This invention relates to a method of producing recording sheets. More particularly, the invention relates to a method of producing recording sheets carrying thereon a color developer capable of coloring on contact with an almost colorless coloring compound (hereinafter, referred to as a color former).

2. Description of the Prior Art

Hitherto, recording materials utilizing the coloring reaction of a color former and compounds (color developers) which cause coloring when brought into contact with the color former are well known. (Examples of the color developer are clayish materials such as acid clay, active clay, attapulgite, zeolite, bentonite, kaolin, etc.; organic acids such as salycilic acid, tarnic acid, gallic acid, a phenol compound, etc., as well as the metal salts of these organic acid compounds; and acid polymers such as phenol formaldehyde resin, etc.). The color former is a material which forms color by donating an electron or by receiving a proton and the color developer is a material which receives an electron or donates a proton.

As recording materials based on the above-described phenomenon, there are pressure-sensitive copying papers as disclosed in, for example, U.S. Pat. Nos. 2,505,470; 2,505,489; 2,550,471; 2,548,366; 2,712,507; 2,730,456; 2,730,457; 3,418,250; and 3,896,255; and heat-sensitive recording papers as disclosed in, for example, Japanese Patent Publication No. 4160/68 (corresponding to U.S. Ser. No. 512546 now abandoned) and U.S. Pat. No. 2,939,009. Furthermore, a printing system is also known in which a colored image or record is obtained by supplying an ink containing a color former onto a recording sheet having coated thereon a color developer through a medium such as stencil as described in, for example, German Offenlegungsschrift 1,939,624. In the case of utilizing the above-described phenomenon in the aforesaid recording or copying systems, the application of local pressure such as by pencil, ball pen, or type writer, the application of heat, or other proper treatment for bringing the color former into contact with the color developer on the recording sheet.

The most typical embodiment of recording materials of this type is a pressure-sensitive copying paper. The color former containing layer for the pressure-sensitive copying paper is prepared by dissolving a color former in a solvent, dispersing the solution in a binder or encapsulating the solution in microcapsules, and then coating the dispersion or the microcapsule-containing coating composition on a support such as paper, plastic film, resin-coated paper, etc. On the other hand, a color developer-containing layer is prepared by dissolving or dispersing a color developer in a medium such as water together with a binder and coating the solution or dispersion on a support.

In general, the color former layer and the color developer layer are formed on the same side of a support or the opposite side of a support respectively, or on the surfaces of different supports separately.

In case of employing microcapsules, the color former in the microcapsules is released by the application of local pressure by hand writing or typewriting to come into contact with the color developer layer, whereby the record in conformity with the local pressure applied is obtained.

Various kinds of color developers are known as described above. However, when active clay, acid clay, etc., which is most frequently used at present, is used as the color developer, there is a difficulty that the colored material or image formed thereon is inferior in light resistance or water resistance. Also, when a phenol monomer or a phenol-formaldehyde resin is used as the color developer, there is also a difficulty that the coated surface is liable to cause yellowing.

The inventors have found that polyvalent metal salts of aromatic carboxylic acid are effective color developers having no such difficulties (see, U.S. Pat. No. 3,934,070).

That is, when the polyvalent metal salts of an aromatic carboxylic acid are used as the color developer, there are such merits as: (1) the colored material or image formed is superior in light resistance, (2) the colored material or image does not fade away by the action of water, and (3) when the coated layer of the color developer is exposed to light, it is slow to yellow, but there are yet several points which can be improved upon.

For example, a coating composition containing the polyvalent metal salt of an aromatic carboxylic acid tends to cause undesirable aggregating or increase the viscosity of coating compositions based on latex binders. Also, in this case, it is difficult to obtain a sufficient surface strength of the coated layer. Still further, even if a coating composition of a polyvalent metal salt of an aromatic carboxylic acid which does not cause the increase of viscosity is used, the surface of the coated paper becomes rough and sufficient smoothness is not obtained. These drawbacks are considered to be due to the fact that the coating composition containing the polyvalent metal salt of an aromatic carboxylic acid provides a high concentration of metal ion when dried after coating which has a bad influence on a binder such as latex, etc., and causes locally aggregation.

As one solution to this problem it may be considered to use a water-soluble binder which is resistant to the metal ion but the use of such a water-soluble binder encounters inevitably such difficulties that the viscosity of the coating composition becomes high and the coated surface in inferior in water resistance.

SUMMARY OF THE INVENTION

An object of this invention is, therefore, to provide a method of producing a recording sheet having excellent smoothness of the coated surface.

Another object of the invention is to provide a method of producing a recording sheet having excellent surface strength of the coated layer.

The above-indicated objects of this invention are attained by coating on a support first a coating composition containing a water-soluble polyvalent metal salt and then a coating composition containing an alkali metal salt or ammonium salt of an aromatic carboxylic acid according to this invention.

By the practice of this invention, the following merits in cost and property are obtained. That is, (1) the step of preparing beforehand a polyvalent metal salt of an aromatic carboxylic acid is unnecessary, (2) the step of pulverizing a polyvalent metal salt is unnecessary, and (3) a very fine polyvalent metal salt can be formed on a support.

DETAILED DESCRIPTION OF THE INVENTION

The aromatic carboxylic acid of the polyvalent metal salt of aromatic carboxylic acid used in this invention includes the compounds represented by the general formula

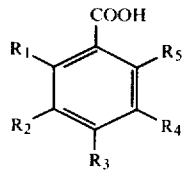

wherein $R_1$, $R_2$, $R_3$, $R_4$ and $R_5$ each represents hydrogen atom, halogen atom, a hydroxy group, an amino group, an alkylamino group, a nitro group, a formyl group, a straight or branch chain alkyl group, a cycloalkyl group, an aryl group, an alkylaryl group, a monocyclic or bicyclic aralkyl group, an alkoxy group, etc., having less than about 18 carbon atoms, said $R_1$ and $R_2$ or said $R_3$ and $R_4$ may close ring with each other to form a 5-membered or 6-membered ring.

In the particularly useful compounds among the compounds of the above-described general formula, $R_1$ is a hydroxy group and at least one of the ortho-position and para-position to the position of the hydroxy group has an alkyl group, an aryl group, or an aralkyl group as the substituent.

Practical examples of the aromatic carboxylic acid are 2,4-dichlorobenzoic acid, p-isopropylbenzoic acid, 2,5-dinitrobenzoic acid, p-t-butylbenzoic acid, N-phenylanthranilic acid, salicylic acid, m-hydroxybenzoic acid, p-hydroxybenzoic acid, 3,5-dinitrosalicylic acid, 5-t-butylsalycilic acid, 3-phenylsalicyclic acid, 3-methyl-5-t-butylsalicyclic acid, 3,5-ditert-amylsalicylic acid, 3-cyclohexylsalicylic acid, 5-cyclohexylsalicylic acid, 3-methyl-5-isoamylsalicylic acid, 5-isoamylsalicylic acid, 3,5-di-sec-butylsalicyclic acid, 5-nonylsalicyclic acid, 2-hydroxy-3-methylbenzoic acid, 2-hydroxy-5-t-butylbenzoic acid, 2,4-cresotic acid, 5,5-methylenesalicylic acid, o-acetaminobenzoic acid, m-acetaminobenzoic acid, p-acetaminobenzoic acid, 2,4-dihydroxybenzoic acid, 2,5-dihydroxybenzoic acid, anacardic acid, 1-naphthoic acid, 2-naphthoic acid, 1-hydroxy-2-naphthoic acid, 2-hydroxy-3-naphthoic acid, 3,5-dicyclohexylsalicylic acid, 3,5-di-t-butylsalicyclic acid, 3,5-di-t-octylsalicyclic acid, 2-hydroxy-1-naphthoic acid, thiosalicyclic acid, etc.

In addition to the aforesaid aromatic carboxylic acids, aromatic carboxylic acids of the above formula which are further addition reacted with an olefin of 4 to 18 carbon atoms or a styrene derivatives can also be used in this invention.

Practical examples of these compounds are 3,5-di(α-methylbenzyl)salicyclic acid, 3-(α-methylbenzyl)-5-(α,α-dimethylbenzyl)salicylic acid, 3-(4'-α',α'-dimethylbenzyl)phenyl-5-(α,α-dimethylbenzyl)salicylic acid, 3-cyclohexyl-5-(α,α-dimethylbenzyl)salicyclic acid, 3-phenyl-5-(α,α-dimethylbenzyl)salicylic acid, 3,5-di(α,α-dimethylbenzyl)salicylic acid, etc.

Examples of the particularly preferred compounds of the above-described compounds are 3,5-di(α-methylbenzyl)salicylic acid, 3-(α-methylbenzyl)-5-(α,α-dimethylbenzyl)salicylic acid, 3-(4'-α',α'-dimethylbenzyl)-phenyl-5-(α,α-dimethylbenzyl)salicylic acid, 3,5-di-t-butylsalicylic acid, 3,5-di-t-octylsalicylic acid, 3-cyclohexyl-5-(α,α-dimethylbenzyl)salicyclic acid, 3-phenyl-5-(α,α-dimethylbenzyl)salicylic acid, 3,5-di(α,α-dimethylbenzyl)salicyclic acid, and 3,5-dicyclohexylsalicylic acid.

As the polyvalent metals for making the metal salts of the aromatic carboxylic acids described above, there are magnesium, aluminum, calcium, scandium, titanium, vanadium, chromium, manganese, iron, cobalt, nickel, copper, zinc, gallium, germanium, strontium, yttrium, zirconium, molybdenum, silver, cadmium, indium, tin, antimony, barium, tungsten, lead, bismuth, etc. Particularly effective metals are zinc, tin, aluminum, magnesium, and calcium. Furthermore, the most effective metal among these metals is zinc.

The water-soluble polyvalent metal salts used in this invention are the salts of the above-illustrated polyvalent metals and hydrochloric acid, sulfuric acid, nitric acid, acetic acid, phosphoric acid, etc. Fundamentally, if the polyvalent metal salts are water-soluble, they can be used in this invention and hence the metal salts are not necessarily limited to the above-described acid salts.

A binder is generally used for preparing the coating composition containing the water-soluble polyvalent metal salt and the coating composition containing an alkali metal salt or ammonium salt of the aromatic carboxylic acid.

The binder is selected based on the strength of the coated layer desired and its influence on the dispersibility and developing faculty of color developer. The binder for the polyvalent metal salt composition used need not be the binder for the aromatic carboxylic acid salt composition although in many industrial applications the two will be the same.

Examples of the water-soluble binder used in this invention may be water-soluble natural polymers such as protein (e.g., gelatin, albumin, casein, etc.,), starch (corn starch, α-starch, oxidized starch, etherified starch, esterified starch, etc.,), cellulose (e.g., carboxymethyl cellulose, hydroxyethyl cellulose, etc.,), saccharose (e.g., agar agar, sodium alginate, carboxymethyl starch, gum arabic, etc.,), and the like and water-soluble synthetic polymers such as polyvinyl alcohol, polyvinylpyrrolidone, polyacrylic acid, polyacrylamide, maleic acid copolymer, and the like.

Also, as latex-type (emulsion-type) binders, there are a styrene-butadiene latex, acrylonitrile-butadiene latex, acrylic acid ester latex, vinyl acetate-type latex, methyl methacrylatebutadiene latex, and the carboxy-denatured latexes of the above latexes.

In the case of using a binder for the coating composition containing the water-soluble polyvalent metal salt, a water-soluble binder which does not contain an anionic group such as carboxy group, sulfo group, etc., is desirably used. Starch and polyvinyl alcohol are particularly desirable. In particular, polyvinyl alcohol is desirable due to its strong binder power.

In this invention, to improve the developing power of the coating compositions and the surface properties of the coated layer and for carrying the water-soluble polyvalent metal salt; metal compounds such as the oxides, hydroxides, silicates, and carbonates of zinc, aluminum, calcium, magnesium, titanium, nickel, cobalt, manganese, iron, tin, copper, vanadium, or chromium; silicate compounds such as pyrophyllite clay, kaolin, halloysite, talc, zeolite, benzonite, acid clay, active clay, etc.; inorganic pigments such as calcium sulfate, barium sulfate, etc.; resin powders and mixtures thereof may be incorporated into the coating compositions. Also, a dispersing agent, defoaming agent, antioxidant, etc., may be added to the coating compositions. (See, for example, U.S. Pat. Nos. 2,711,375; 3,625,736; 3,836,383; and 3,846,331 and British Pat. No. 1,232,347).

Also, other developers, for example, organic acids such as clays, phenols, phenol resins, aromatic carboxylic acids, etc., having the property defined above may be used together with the above-described aromatic carboxylic acid salt in the coating composition.

The method of this invention will be described below in more detail.

First, any coating method used in the field of the art can be employed in this invention. For example, an air knife coater, roll coater, blade coater, size press coater, curtain coat, etc., may be employed. In particular, it is profitable to form the first layer by a size press coat.

In this invention, a desired effect is obtained when the second layer (the alkali metal or ammonium salt of the aromatic carboxylic acid) is coated wet in a wet manner. For this purpose, the employment of a blade coat, curtain coat, etc., is desirable as a coating method which does not rough the coated surface. Among them, a curtain coat is particularly desirable. The coated amount depends to some extent on the additives such as pigments, etc., used in the composition but the amount of the aromatic carboxylic acid is usually about 0.05 to 6 g/m$^2$, preferably about 0.1 to 3 g/m$^2$. If the amount is too small, sufficient developing power is not obtained and the upper limit of the coated amount is set mainly for economical reason rather than from any aspect of property.

The coating composition containing the water-soluble polyvalent metal salt, which is first coated on a support, is prepared by dissolving the water-soluble polyvalent metal salt in water solely or dispersing it in water together with a pigment. In the case of using a pigment, a binder is necessary and the amount of the binder is generally less than 50 parts by weight, preferably less than 20 parts by weight per 100 parts by weight of the solid contents. The coated amount of the polyvalent metal salt is usually in the range of 0.005 to 10 g/m$^2$ and preferably 0.01 to 1 g/m$^2$.

The alkali metal salt or ammonium salt of an aromatic carboxylic acid coated after coating the water-soluble polyvalent metal salt described above is prepared by dissolving an aromatic carboxylic acid in an aqueous alkali solution. As the alkali, sodium hydroxide, potassium hydroxide, ammonium hydroxide, etc., but among them, sodium hydroxide and potassium hydroxide are particularly desirable.

The coating composition is prepared by adding one or more pigments and a binder to the aforesaid aqueous alkali solution of the aromatic carboxylic acid.

The amount of the pigment or pigments referred to above added is about 10 to 10,000 parts by weight, preferably 100 to 5,000 parts by weight per 100 parts of the aromatic carboxylic acid.

Also, in regard to the binder, it is desired to use a water-soluble binder together with a latex-type (emulsion type) binder. As the latex-type binders, a styrene-butadiene (SBR) latex, an acrylic acid-series latex, and their carboxy-denatured latexes are preferred and among them, carboxy-denatured SBR latex is particularly preferred. In this case, the proportion of the latex (solid content is 10 to 1,000 parts by weight, preferably, 50 to 500 parts by weight per 100 parts by weight of the water-soluble binder. The total amount of binder is less than 50 parts by weight, preferably less than 20 parts by weight per 100 parts by weight of solid contents (e.g., pigment and salt).

It is preferred that the coating composition containing the water-soluble polyvalent metal salt and the coating composition containing the aromatic carboxylic acid alkali salt be coated successively or the aromatic carboxylic acid salt composition may be coated after drying the first composition and winding. It is preferred that they are coated continuously and successively in a wet manner.

On the other hand, different from the invention, a method wherein the coating composition containing the alkali salt of an aromatic carboxylic acid is first coated on a support and then the coating composition containing the water-soluble polyvalent metal salt does not provide practically useful properties since in this case, (1) the surface strength of coated layer becomes uneven and the surface of the coated layer becomes very rough and (2) the aromatic carboxylic acid diffused greatly in the support.

There is no particular limitation on the types of color former which cause coloring reaction with the color developer used in the recording sheet of this invention but practical examples of the color former used in this invention are as follows.

Triarylmethane compounds such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis(2-phenylindole-3-yl)-5-dimethylaminophthalide, 3-p-dimethylaminophenyl-3-(1-methylpyrrole-2-yl)-6-dimethylaminophthalide, etc.

Diphenylmethane compounds such as 4,4'-bis-dimethylaminobenzhydrine benzyl ether, N-halophenyl leuco Auramine, N-2,4,5-trichlorophenyl leuco Auramine, etc.

Xanthene compounds such as Rhodamine B-anilinolactam, Rhodamine B-p-nitroanilinolactam, Rhodamine B-p-chloroanilinolactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,2-dimethylfluoran, 7-diethylamino-3-acetylmethylaminofluoran, 7-diethylamino-3'-methylaminofluoran, 3,7-diethylaminofluoran, 7-diethylamino-3-dibenzylaminofluoran, 7-diethylamino-3-methylbenzylaminofluoran, 7-diethylamino-3-chloromethylaminofluoran, 7-diethylamino-3-diethylaminofluoran, etc.

Thiazine compounds such as benzoyl leucomethylene blue, p-netrobenzoyl leucomethylene blue, etc.

Spiro compounds such as 3-methyl-spiro-dinaphthopyran, 3-ethyl-spiro-dinaphthopyran, 3,3'-dichlorospiro-dinaphthopyran, 3-benzyl-spiro-dinaphthopyran, 3-methylnaphtho-(3-methoxybenzo)-spiro-pyran, 3-propyl-spiro-dibenzopyran, etc.

They may be used solely in admixture. These color formers are selected according to the use and the property desired. Among them, however, triarylmethane compounds, particularly Crystal Violet lactone are more preferably used in this invention.

The color former is dissolved in a solvent and the solution is encapsulated or dispersed in a binder solution prior to coating on the support.

As the solvent for the color former, a natural oil and a synthetic oil may be used individually or as a mixture of them. Examples of the solvent employed in this invention are cotton seed oil, kerosene, alkylated terphenyl, alkylated naphthalene, diarylethane, triarylmethane, chlorinated paraffin, etc.

The encapsulation of the color former solution may be performed by the method of utilizing coacervation of a hydrophilic colloid as described in U.S. Pat. Nos. 2,800,457 and 2,800,458 or interfacial polymerization as described in British Pat. Nos. 867,797; 950,443; 989,264; and 1,091,076.

The merits obtained by the present invention are first, the smoothness of the coated surface of the recording sheet is improved, and, second, the surface strength of the coated layer is improved. These merits in the recording materials of this invention have been confirmed for the following developer-carrying recording sheet.

PREPARATION OF COLOR FORMER SHEET

Microcapsules containing color former were prepared according to the method described in, for example, U.S. Pat. No. 2,800,457, the practical example thereof being shown below in which all parts, percents and ratios are by weight.

In 400 parts of water at 40° C. are dissolved 10 parts of acid-treated pig skin gelatin and 10 parts of gum arabic and after adding thereto 0.2 part of Turkey red oil as an emulsifier, 40 parts of a color former containing oil is dispersed by emulsification in the solution. The color former oil used was prepared by dissolving 2% Crystal Violet lactone in diisopropyl naphthalene.

When the mean size of oil droplets reaches 5 microns, the emulsification is stopped and then water at 40° C. is added to make 900 parts followed by stirring. The mixture is adjusted to a pH of 4.0 to 4.2 by the addition of 10 wt.% acetic acid to cause coacervation. The system is further stirred and after 20 minutes, the system is cooled by ice-water to gel the coacervated films deposited around the oil droplets.

When the temperature of the system becomes 20° C., 7 parts of 37 wt.% formalin is added to the system. When the temperature thereof becomes 10° C., an aqueous 15 wt% sodium hydroxide solution is added to adjust the pH thereof to 9. The mixture is then stirred for 20 minutes under heating to raise the temperature to 50° C.

The microcapsule dispersion thus prepared is cooled to 30° C. and then coated on a paper support of 40 g/m$^2$ at a coverage of 6 g/m$^2$ of solid contents and dried.

Thus, a sheet having coated thereon microcapsules containing Crystal Violet lactone is obtained.

EXAMPLE 1

An aqueous 1% zinc sulfate solution was coated on a base paper of 50 g/m$^2$ by means of a size press coater. In this case, the coated amount was 0.1 to 0.2 g/m$^2$ as solid contents.

Then, 100 parts of 3,5-di-tert-butylsalicyclic acid was dissolved in 160 parts of an aqueous 10% sodium hydroxide solution and a solution or dispersion of 100 parts of zinc oxide, 900 parts of kaolin, and 10 parts of sodium hexametaphosphate in 1,500 parts of water was added to the above-prepared solution followed by stirring uniformly. Then, 400 parts of an aqueous solution of 10% polyvinyl alcohol (saponification degree of 98% and polymerization degree of 1,700) and 90 parts as solid content of carboxy-denatured SBR latex were added to the dispersion to provide a coating composition. The coating composition was coated on the coated layer of zinc sulfate on the paper by means of a blade coater at a coverage of 4 to 5 g/m$^2$ of solid content followed by drying to provide the recording sheet of this invention.

COMPARISON EXAMPLE 1

In a solution of 10 parts of sodium hexametaphosphate in 1,500 parts of water were dispersed 100 parts of zinc 3,5-di-tert-butylsalicylate, 100 parts of zinc oxide, and 900 parts of kaolin and the mixture was treated for one hour by means of attriter to disperse sufficiently the additives. After further adding 3,000 parts of water to the dispersion followed by stirring uniformly, 400 parts of an aqueous solution of 10% polyvinyl alcohol (saponification degree of 98% and polymerization degree of 1,700) and 90 parts as solid content of a carboxy-denatured SBR latex were added to the dispersion to provide a coating composition. The coating composition was coated on a base paper of 50 g/m$^2$ by means of an air knife coater at a coverage of 4 to 5 g/m$^2$ of solid content and dried to provide a recording sheet.

EXAMPLE 2

In 100 parts of an aqueous solution of 1% polyvinyl alcohol (saponification degree of 98% and polymerization degree of 2,400) were dissolved or dispersed 10 parts of zinc sulfate and 100 parts of zinc oxide to provide coating composition A.

Then, 100 parts of 3,5-di(α-methylbenzyl)salicylic acid was dissolved in 120 parts of an aqueous solution of 10% sodium hydroxide and a solution or dispersion of 100 parts of zinc oxide, 90 parts of kaolin, and 10 parts of sodium hexametaphosphate in 5,000 parts of water was added to the solution followed by mixing uniformly.

Thereafter, 400 parts of an aqueous solution of 10% polyvinyl alcohol (saponification degree of 98% and polymerization degree of 2,400) and 90 parts as solid content of a carboxy-denatured SBR latex were added to the dispersion to provide coating composition B.

Coating composition A and coating composition B were coated simultaneously on a base paper of 50 g/m$^2$ such that coating composition B overcoated composition A followed by drying to provide the recording sheet of this invention.

COMPARISON EXAMPLE 2

By following the same procedure as in Comparison Example 1 except that zinc 3,5-di(α-methylbenzyl)salicylate was used in place of zinc 3,5-di-tert-butylsalicylate and polyvinyl alcohol (saponification degree of 98% and polymerization degree of 2,400) was used in place of the polyvinyl alcohol (saponification degree of 98% and polymerization degree of 1,700), a comparison recording sheet was prepared.

COMPARISON TEST (1) Smoothness of coated surface:

The recording sheets of this invention and the comparison recording sheets prepared above were superposed on a sheet carrying the microcapsules containing Crystal Violet lactone. The assembly was set on a table under a plurality of rubber balls. While applying a load of 200 g to the balls, the assembly was moved and then the color stain density on the surface of the color developer layer was measured by means of a reflection-type spectrophotometer. The result was employed as abrasion stain density. The color stain is less as the surface of the recording sheet is smoother. The results are shown in the following table.

(2) Picking strength:

Using the recording sheet of this invention and the comparison recording sheet, the picking strength was compared by means of an RI tester ("RI-I-type IR tester" (trademark) manufactured by Akira Seisakusho Co.). As the ink, 0.75 g of black ink having tack strength of 15 was used. It is desirable that the picking strength be strong. As the picking strength is higher, the stain of printing plate at printing is less. The results are shown in the following table.

TABLE

| Example or Comparison Example | | Abrasion Strain Density | Picking Strength | Feeling |
|---|---|---|---|---|
| Example 1 | $D_{610\ nm}$ | = 0.12 | excellent | excellent (smooth) |
| Comparison Example 1 | " | = 0.25 | inferior | inferior |
| Example 2 | " | = 0.09 | excellent | excellent (smooth) |
| Comparison Example 2 | " | = 0.23 | inferior | inferior |

From the above results, it will be understood that the recording sheets prepared according to the method of this invention had very excellent smoothness and picking strength of coated layer.

Moreover, when the recording sheets of this invention were used in a combination with the sheet having microcapsule layer containing Crystal Violet lactone, colored records or image having excellent color density and light resistance were obtained.

While the invention has been described in detail and with reference to the specific embodiments thereof, it will be apparent to one skilled in the art that various changes and modifications can be made therein without departing from the spirit and scope thereof.

What we claim is:

1. A method of producing a recording sheet which comprises coating a support first with a coating composition containing a water-soluble polyvalent metal salt and then with a coating composition containing an alkali metal salt or ammonium salt of an aromatic carboxylic acid.

2. The method of claim 1, wherein said water-soluble polyvalent metal salt is a chloride, sulfate, nitrate, acetate or phosphate of zinc, tin, aluminum, magnesium, or calcium.

3. The method of claim 1, wherein said water-soluble polyvalent metal salt is zinc sulfate.

4. The method of claim 1, wherein said water-soluble polyvalent metal salt is zinc sulfate and the composition additionally contains zinc oxide.

5. The method of claim 1, wherein said aromatic carboxylic acid is a compound represented by the general formula

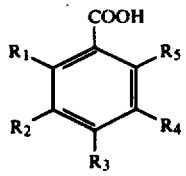

wherein $R_1$, $R_2$, $R_3$, $R_4$ and $R_5$ each represents a hydrogen atom, a halogen atom, a hydroxy group, an amino group, an alkylamino group, a nitro group, a formyl group, an alkyl group, a cycloalkyl group, an aryl group, an alkylaryl group, an aralkyl group, or an alkoxy group; and said $R_1$ and $R_2$ or $R_3$ and $R_4$ may combine to form a 5-membered or 6-membered ring.

6. The method of claim 1, wherein said polyvalent metal salt is coated in an amount of from about 0.005 $g/m^2$ to 10 $g/m^2$.

7. The method of claim 1, wherein said aromatic carboxylic acid salt is coated in an amount of from about 0.1 $g/m^2$ to 3 $g/m^2$.

8. The method of claim 1, wherein said aromatic carboxylic acid salt composition is coated immediately after said polyvalent metal salt composition while said polyvalent metal composition is still wet.

9. The method of claim 1 wherein said aromatic carboxylic acid comprises the addition reaction product of an aromatic carboxylic acid represented by the general formula

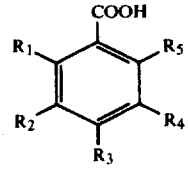

wherein $R_1$, $R_2$, $R_3$, $R_4$ and $R_5$ each represents a hydrogen atom, a halogen atom, a hydroxy group, an amino group, an alkylamino group, a nitro group, a formyl group, an alkyl group, a cycloalkyl group, an aryl group, an alkylaryl group, an aralkyl group, or an alkoxy group; and said $R_1$ and $R_2$ or $R_3$ and $R_4$ may combine to form a 5-membered or 6-membered ring; with an olefin having 4 to 18 carbon atoms or styrene or a derivative thereof.

10. The method of claim 1, wherein said coating compositions additionally contain an additive for improving the developing power of the compositions and the surface properties of the coated layer.

11. The method of claim 10, wherein said additive is a metal oxide.

12. The method of claim 1, wherein said coating compositions contain a water-soluble binder.

* * * * *